US010830087B2

(12) United States Patent
Pacuk et al.

(10) Patent No.: US 10,830,087 B2
(45) Date of Patent: Nov. 10, 2020

(54) MODULAR VARIABLE VANE ASSEMBLY

(71) Applicant: United Technologies Corporation, Farmington, CT (US)

(72) Inventors: Jonathon T. Pacuk, Rocky Hill, CT (US); John C. Ditomasso, Glastonbury, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 66 days.

(21) Appl. No.: 16/214,829

(22) Filed: Dec. 10, 2018

(65) Prior Publication Data

US 2020/0182082 A1 Jun. 11, 2020

(51) Int. Cl.
*F01D 17/16* (2006.01)
*F01D 9/04* (2006.01)
*F04D 29/56* (2006.01)

(52) U.S. Cl.
CPC ..... *F01D 17/162* (2013.01); *F01D 9/041* (2013.01); *F04D 29/563* (2013.01); *F05D 2220/3217* (2013.01); *F05D 2240/128* (2013.01)

(58) Field of Classification Search
CPC ..... F01D 17/162; F01D 9/041; F04D 29/563
USPC ..... 415/160
See application file for complete search history.

(56) References Cited

U.S. PATENT DOCUMENTS 4,135,362 A * 1/1979 Glenn ..... F02C 6/08 415/115
5,873,700 A * 2/1999 Ichikawa ..... F01D 5/288 415/160
6,450,763 B1 9/2002 Crum et al.
7,104,754 B2 * 9/2006 Willshee ..... F01D 17/162 415/159
7,131,815 B2 * 11/2006 Allford ..... F01D 17/162 415/160
7,223,066 B2 * 5/2007 Rockley ..... F01D 17/162 415/160
7,828,518 B2 * 11/2010 Evans ..... F01D 9/042 415/161
8,033,785 B2 10/2011 Thermos et al.
9,074,489 B2 * 7/2015 Eleftheriou ..... F01D 17/162
(Continued)

FOREIGN PATENT DOCUMENTS

EP 1892422 A1 * 2/2008 ..... F04D 29/563
EP 1892422 A1 2/2008
(Continued)

OTHER PUBLICATIONS

European Search Report for Application No. EP 19 21 4980; dated Apr. 20, 2020.

*Primary Examiner* — Michael Lebentritt
*Assistant Examiner* — Topaz L. Elliott
(74) *Attorney, Agent, or Firm* — Cantor Colburn LLP

(57) ABSTRACT

A modular variable vane assembly includes an airfoil, an inner case, and an outer case. The airfoil extends between a first end and a second end along an axis. The airfoil has a connector that extends from the first end and a pivot member that extends from the second end. The inner case defines a pivot opening that is arranged to receive the pivot member. The outer case defines a first opening that extends from a first outer case surface towards a second outer case surface along the axis. The first opening is arranged to receive the connector.

14 Claims, 2 Drawing Sheets

(56) References Cited

U.S. PATENT DOCUMENTS

| | | | | |
|---|---|---|---|---|
| 9,228,438 | B2 | 1/2016 | Dube et al. | |
| 10,036,282 | B2 * | 7/2018 | Cheng | F01D 25/28 |
| 2007/0160464 | A1 | 7/2007 | Lesnevsky et al. | |
| 2014/0169950 | A1 | 6/2014 | Dube et al. | |
| 2015/0345322 | A1 * | 12/2015 | Cheng | F01D 17/162 415/115 |

FOREIGN PATENT DOCUMENTS

| | | | | |
|---|---|---|---|---|
| EP | 2407673 | A1 * | 1/2012 | F04D 29/563 |
| EP | 2407673 | A1 | 1/2012 | |
| FR | 2583820 | A1 * | 12/1986 | F01D 17/162 |
| JP | 55114883 | A * | 9/1980 | |

* cited by examiner

MODULAR VARIABLE VANE ASSEMBLY

BACKGROUND

A gas turbine engine may be provided with a variable vane that may pivot about an axis to vary the angle of the vane airfoil to optimize compressor operability and/or efficiency at various compressor rotational speeds. Variable vanes enable optimized compressor efficiency and/or operability by providing a close-coupled direction of the gas flow into the adjacent downstream compressor stage and/or may introduce swirl into the compressor stage to improve low speed operability of the compressor as well as to increase the flow capacity at high speeds.

BRIEF DESCRIPTION

Disclosed is a gas turbine engine having a central longitudinal axis. The gas turbine engine includes an inner case, an outer case spaced apart from the inner case, and a modular variable vane assembly. The modular variable vane assembly includes an airfoil and a drive system. The airfoil extends between the inner case and the outer case along an axis that is disposed transverse to the central longitudinal axis. The airfoil has a connector that extends from a first end of the airfoil and into the outer case and a pivot member that extends from a second end of the airfoil and into the inner case. The drive system extends at least partially through the outer case and is connected to the connector. The drive system is arranged to pivot the airfoil about the axis.

In addition to one or more of the features described above, or as an alternative to any of the foregoing embodiments, a trunnion arm and a trunnion head extending from the trunnion arm, the trunnion head arranged to engage the connector of the airfoil.

In addition to one or more of the features described above, or as an alternative to any of the foregoing embodiments, the trunnion head extends at least partially into the connector.

In addition to one or more of the features described above, or as an alternative to any of the foregoing embodiments, a retainer disposed on the outer case and at least partially disposed about the trunnion arm.

In addition to one or more of the features described above, or as an alternative to any of the foregoing embodiments, the retainer being arranged to retain the trunnion head between the retainer and the outer case.

Further disclosed is a modular variable vane assembly for a compressor section of a gas turbine engine. The modular variable vane assembly includes an airfoil, an inner case, and an outer case. The airfoil extends between a first end and a second end along an axis. The airfoil has a connector that extends from the first end and a pivot member that extends from the second end. The inner case defines a pivot opening that is arranged to receive the pivot member. The outer case defines a first opening that extends from a first outer case surface towards a second outer case surface along the axis. The first opening is arranged to receive the connector.

In addition to one or more of the features described above, or as an alternative to any of the foregoing embodiments, the connector is aligned with the pivot member along the axis.

In addition to one or more of the features described above, or as an alternative to any of the foregoing embodiments, the first outer case surface disposed closer to the inner case than the second outer case surface.

In addition to one or more of the features described above, or as an alternative to any of the foregoing embodiments, the outer case defining a first cavity that extends from the second outer case surface towards the first opening.

In addition to one or more of the features described above, or as an alternative to any of the foregoing embodiments, a drive system provided with a trunnion arm having a trunnion head that extends along the axis through the first cavity and into the connector.

In addition to one or more of the features described above, or as an alternative to any of the foregoing embodiments, a retainer having a first retainer surface disposed on the outer case and a second retainer surface disposed opposite the first retainer surface.

In addition to one or more of the features described above, or as an alternative to any of the foregoing embodiments, the retainer defining a second opening that extends from the second retainer surface towards the first retainer surface.

In addition to one or more of the features described above, or as an alternative to any of the foregoing embodiments, the retainer defining a second cavity that extends from the first retainer surface towards the second opening.

In addition to one or more of the features described above, or as an alternative to any of the foregoing embodiments, the trunnion head extends between the first cavity and the second cavity.

Also disclosed is a modular variable vane assembly. The modular variable vane assembly includes an airfoil, an outer case, a retainer, and a trunnion arm. The airfoil has a connector that extends from a first end of the airfoil. The outer case defines a first opening that extends from a first outer case surface towards a second outer case surface. The first opening is arranged to receive the connector. The retainer defines a second opening that extends from a second retainer surface disposed opposite a first retainer surface that engages the second outer case surface. The trunnion arm extends through the second opening. The trunnion arm has a trunnion head that extends into the connector.

In addition to one or more of the features described above, or as an alternative to any of the foregoing embodiments, the outer case defining a first cavity that extends from the second outer case surface towards the first opening.

In addition to one or more of the features described above, or as an alternative to any of the foregoing embodiments, the retainer defining a second cavity that extends from the first retainer surface towards the second opening.

In addition to one or more of the features described above, or as an alternative to any of the foregoing embodiments, the trunnion head is retained between the first cavity and the second cavity by the retainer.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
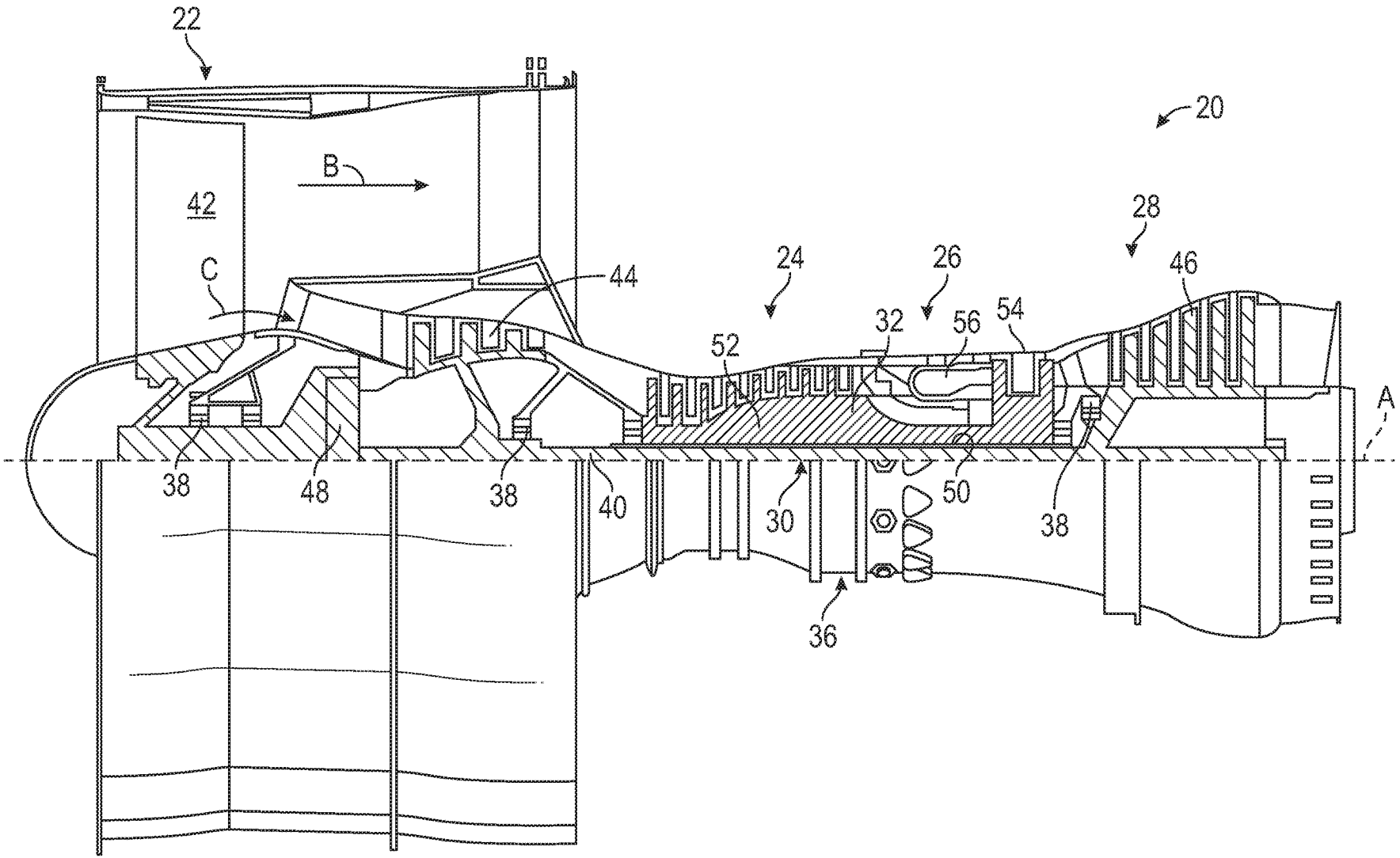
FIG. 1 is a partial cross-sectional view of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five (5:1). Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,688 meters). The flight condition of 0.8 Mach and 35,000 ft (10,688 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram °R})/(518.7\text{°R})]^{0.5}$. The "Low corrected fan tip speed" as disclosed herein according to one non-limiting embodiment is less than about 1150 ft/second (350.5 m/sec).

Figure 2:
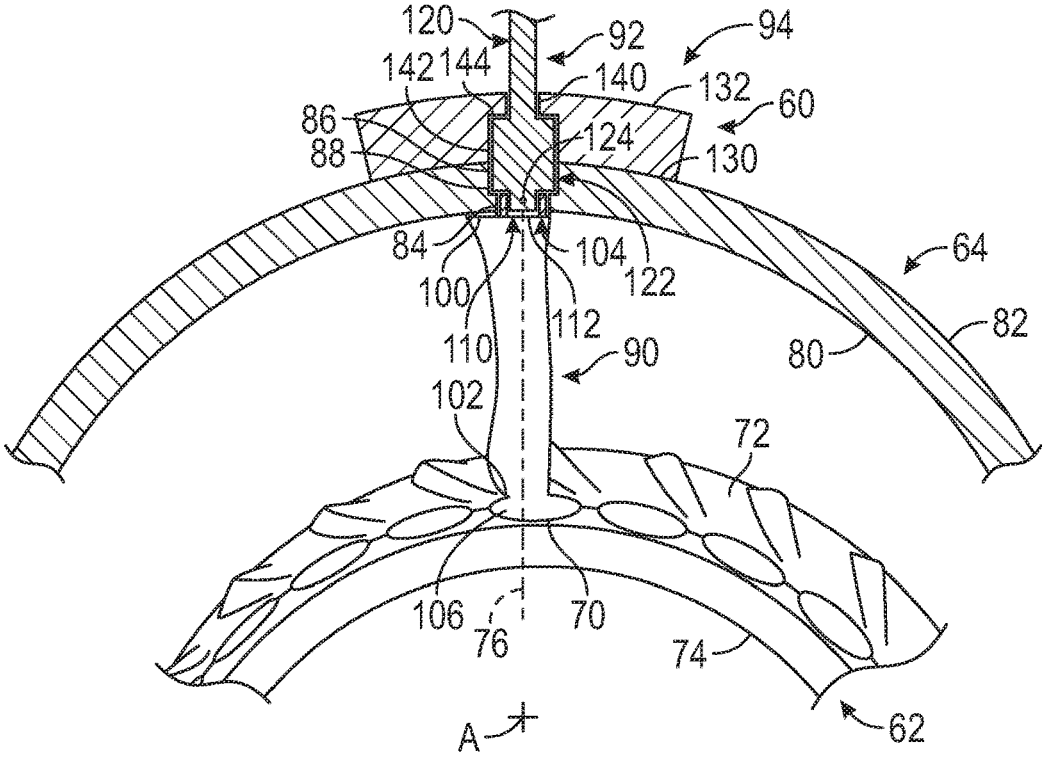
FIG. 2 is a partial front perspective view of a modular variable vane assembly provided with a compressor section of the gas turbine engine.

Referring to FIG. 2, the compressor section 24 may be provided with a modular variable vane assembly 60. The modular variable vane assembly 60 may be an inlet guide vane assembly that is located upstream of a rotor of a stage of at least one of the low pressure compressor 44 or the high pressure compressor 52. The modular variable vane assembly 60 extends between an inner case 62 and an outer case 64 of the compressor section 24.

The inner case 62 is disposed about the central longitudinal axis A of the gas turbine engine 20. The inner case 62 may be a portion of an inner shroud. The inner case 62 defines a pivot opening 70 that extends from an inner case first surface 72 towards an inner case second surface 74 along an axis 76 that is disposed transverse to the central longitudinal axis A.

The outer case 64 is spaced apart from the inner case 62 and is disposed about the inner case 62. The outer case 64 is further away from axis A than the inner case 62. The outer case 64 includes a first outer case surface 80 and a second outer case surface 82. The first outer case surface 80 is disposed closer to the inner case 62 than the second outer case surface 82.

Figure 3:
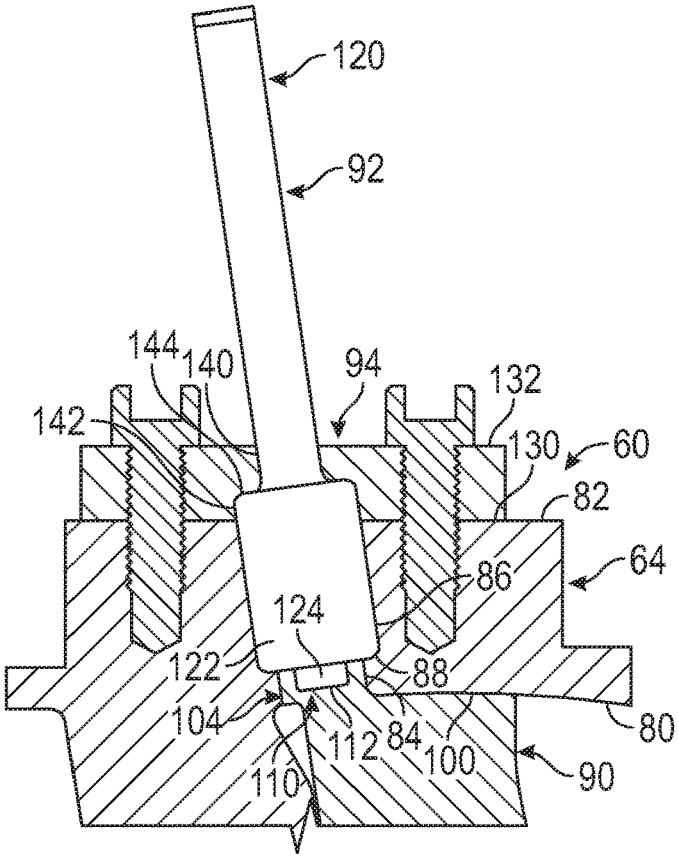
FIG. 3 is a partial side perspective view of a portion of the modular variable vane assembly.

Referring to FIGS. 2 and 3, the outer case 64 defines a first opening 84, a first cavity 86, and a first shoulder 88. The first opening 84 extends from the first outer case surface 80 towards the second outer case surface 82 along the axis 76. The first cavity 86 extends from the second outer case surface 82 towards the first opening 84. The first cavity 86 has a cross-sectional form that is greater than the cross-sectional form of the first opening 84. The first shoulder 88 extends between ends of the first opening 84 and the first cavity 86.

Referring to FIGS. 2 and 3, the modular variable vane assembly 60 includes an airfoil 90, a drive system 92, and a retainer 94. The airfoil 90 radially extends between the inner case 62 and the outer case 64. The airfoil 90 radially extends between a first end 100 that is disposed proximate the first outer case surface 80 of the outer case 64 and a second end 102 that is disposed proximate the inner case first surface 72 of the inner case 62 along the axis 76. The first end 100 of the airfoil 90 is disposed at a further radial distance from the axis A and the second end 102 of the airfoil 90.

The airfoil 90 includes a connector 104 and a pivot member 106. The connector 104 extends from the first end 100 of the airfoil 90 into the first opening 84 of the outer case 64. The connector 104 may be referred to as an outer diameter button. The outer diameter button may be integrally formed with the airfoil 90. The outer diameter button of the present disclosure has a low profile such that the outer diameter button or connector 104 may be inserted into the first opening 84 of the outer case 64.

The connector 104 may be a female connector, as illustrated in FIGS. 2 and 3, or may be a male connector in other arrangements. The connector 104 defines a receiving pocket 110 having a pocket floor 112. The receiving pocket 110 is arranged to receive at least a portion of the drive system 92. The receiving pocket 110 may define a polygon drive interface. The pocket floor 112 may be disposed substantially flush with the first outer case surface 80, as shown in FIG. 2, or may be disposed radially outboard of the first outer case surface 80 such that the pocket floor 112 is radially disposed between the first outer case surface 80 and the second outer case surface 82, as shown in FIG. 3. Such an arrangement moves the drive system 92 away from the flow path that is defined between the outer case 64 and the inner case 62.

The pivot member 106 extends from the second end 102 of the airfoil 90 and extends into the pivot opening 70 of the inner case 62. The pivot member 106 may be referred to as an inner diameter button that may be integrally formed with the airfoil 90. The inner diameter button or the pivot member 106 is arranged to facilitate the pivoting of the airfoil 90 about the axis 76. The pivot member 106 and the connector 104 are aligned with each other along the axis 76 such that through operation of the drive system 92, the airfoil 90 may be pivoted or rotated about the axis 76.

The drive system 92 extends at least partially through the outer case 64 and is arranged to pivot the airfoil 90 about the axis 76. The drive system 92 includes a trunnion having a trunnion arm 120 and a trunnion head 122 that extends from the trunnion arm 120.

The trunnion arm 120 extends through an opening that is defined by the retainer 94 along the axis 76. The trunnion arm 120 is connected to a transmission or other device that is arranged to rotate the trunnion arm 120 about the axis 76.

The trunnion head 122 may be an enlarged head having a cross-sectional form that is larger than the trunnion arm 120. The trunnion head 122 extends along the axis 76 through the first cavity 86 and into the connector 104. A first end of the trunnion head 122 may be disposed generally parallel to the first shoulder 88 of the outer case 64. The first end of the trunnion head 122 may be arranged to engage the first shoulder 88 of the outer case 64.

The trunnion head 122 defines connecting head 124 having a cross-sectional form that is less than the cross-sectional form of the trunnion head 122. The connecting head 124 extends into the receiving pocket 110.

The connecting head 124 may have a mating polygon drive that mates with the polygon drive interface of the receiving pocket 110 of the connector 104 to facilitate the driving of the airfoil 90 about the axis 76. The connecting head 124 may act as a male connector that extends into the female connector defined by the connector 104 of the airfoil 90. The trunnion head 122 and the connecting head 124 are each spaced apart from and do not extend beyond the first outer case surface 80 towards the inner case 62.

The retainer 94 is disposed on the second outer case surface 82 of the outer case 64 and is at least partially disposed about the trunnion arm 120 to retain the trunnion head 122 between the retainer 94 and the outer case 64. The retainer 94 may be secured to the outer case 64 by fasteners that extend through the retainer 94 and extend into the outer case 64. The retainer 94 includes a first retainer surface 130 that engages the second outer case surface 82 and a second retainer surface 132 that is disposed opposite the first retainer surface 130.

The retainer 94 defines a second opening 140, a second cavity 142, and a second shoulder 144 that extends between the second opening 140 and the second cavity 142. The second opening 140 extends from the second retainer surface 132 towards the first retainer surface 130. The second cavity 142 extends from the first retainer surface 130 towards the second opening 140. The second shoulder 144 extends between ends of the second opening 140 and the second cavity 142. A second end of the trunnion head 122 that is disposed opposite the connecting head 124 may be disposed generally parallel to the second shoulder 144 of the retainer 94. The second end of the trunnion head 122 may be arranged to engage the second shoulder 144 of the retainer 94.

The trunnion head 122 is disposed within or extends between the first cavity 86 of the outer case 64 and the second cavity 142 of the retainer 94. The connecting head 124 extends beyond the second cavity 142 and extends into the first opening 84 of the outer case 64 such that the connecting head 124 is received within the receiving pocket 110 of the connector 104 of the airfoil 90.

The modular arrangement of the variable vane assembly enables the trunnion arm 120 and the trunnion head 122 of the drive system 92 to be inserted into the first end 100 of the airfoil 90. This arrangement reduces the complexity of the design and moves the drive system 92 away from the flow path that is defined between the inner case 62 and the outer case 64.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A gas turbine engine having a central longitudinal axis, comprising:

an inner case and an outer case spaced apart from the inner case; and a modular variable vane assembly, comprising:

an airfoil extending between the inner case and the outer case along an axis that is disposed transverse to the central longitudinal axis, the airfoil having a connector that extends from a first end of the airfoil and into the outer case and a pivot member that extends from a second end of the airfoil and into the inner case, and a drive system that extends at least partially through the outer case and is connected to the connector, the drive system being arranged to pivot the airfoil about the axis, the drive system including a trunnion arm and a trunnion head extending from the trunnion arm, the trunnion head arranged to engage the connector of the airfoil, the trunnion head having a cross-sectional form that is larger than the trunnion arm; and a retainer disposed on the outer case and at least partially disposed about the trunnion arm, the outer case defining a first cavity and a first shoulder and the retainer defining a second cavity and a second shoulder, wherein the trunnion head extends between the first cavity of the outer case and the second cavity of the retainer and a first end of the trunnion head is disposed generally parallel to the first shoulder and a second end of the trunnion head is disposed generally parallel to the second shoulder.

2. The gas turbine engine of claim 1, wherein the trunnion head has a connecting head that extends at least partially into the connector and the connecting head has a cross sectional form that is less than the cross sectional form of the trunnion head.

3. The gas turbine engine of claim 1, wherein the retainer is arranged to retain the trunnion head between the retainer and the outer case.

4. A modular variable vane assembly for a compressor section of a gas turbine engine, comprising:

an airfoil extending between a first end and a second end along an axis, the airfoil having a connector that extends from the first end and a pivot member that extends from the second end;

an inner case defining a pivot opening that is arranged to receive the pivot member;

an outer case defining a first opening that extends from a first outer case surface towards a second outer case surface along the axis, the first opening being arranged to receive the connector;

a drive system that extends at least partially through the outer case and is connected to the connector, the drive system being arranged to pivot the airfoil about the axis, the drive system including a trunnion arm and a trunnion head extending from the trunnion arm, the trunnion head arranged to engage the connector of the airfoil, the trunnion head having a cross-sectional form that is larger than the trunnion arm; and a retainer disposed on the outer case and at least partially disposed about the trunnion arm, the outer case defining a first cavity and a first shoulder and the retainer defining a second cavity and a second shoulder, wherein the trunnion head extends between the first cavity of the outer case and the second cavity of the retainer and a first end of the trunnion head is disposed generally parallel to the first shoulder and a second end of the trunnion head is disposed generally parallel to the second shoulder.

5. The modular variable vane assembly of claim 4, wherein the connector is aligned with the pivot member along the axis.

6. The modular variable vane assembly of claim 4, wherein the first outer case surface disposed closer to the inner case than the second outer case surface.

7. The modular variable vane assembly of claim 4, wherein the first cavity extends from the second outer case surface towards the first opening.

8. The modular variable vane assembly of claim 7, wherein the retainer defines a second opening that extends from the second retainer surface towards the first retainer surface.

9. The modular variable vane assembly of claim 8, wherein the second cavity extends from the first retainer surface towards the second opening.

10. The modular variable vane assembly of claim 4, wherein the trunnion head has a connecting head that extends at least partially into the connector and the connecting head has a cross sectional form that is less than the cross sectional form of the trunnion head.

11. A modular variable vane assembly, comprising:

an airfoil having a connector that extends from a first end of the airfoil;

an outer case defining a first opening that extends from a first outer case surface towards a second outer case surface, the first opening being arranged to receive the connector;

a retainer defining a second opening that extends from a second retainer surface disposed opposite a first retainer surface that engages the second outer case surface; and a trunnion arm extending through the second opening, the trunnion arm having a trunnion head, the trunnion head arranged to engage the connector of the airfoil, the trunnion head having a cross-sectional form that is larger than the trunnion arm; and the retainer at least partially disposed about the trunnion arm, the outer case defining a first cavity and a first shoulder and the retainer defining a second cavity and a second shoulder, wherein the trunnion head extends between the first cavity of the outer case and the second cavity of the retainer and a first end of the trunnion head is disposed generally parallel to the first shoulder and a second end of the trunnion head is disposed generally parallel to the second shoulder.

12. The modular variable vane assembly of claim 11, wherein the first cavity extends from the second outer case surface towards the first opening.

13. The modular variable vane assembly of claim 12, wherein the second cavity extends from the first retainer surface towards the second opening.

14. The modular variable vane assembly of claim 11, wherein the trunnion head has a connecting head that extends at least partially into the connector and the connecting head has a cross sectional form that is less than the cross sectional form of the trunnion head.

* * * * *